US006510768B2

(12) United States Patent
Frühm

(10) Patent No.: US 6,510,768 B2
(45) Date of Patent: Jan. 28, 2003

(54) BATTERY-POWERED SCREWDRIVER WITH INTEGRAL BIT HOLDER

(75) Inventor: Hermann Frühm, Coquitlam (CA)

(73) Assignee: Winsire Enterprises Corporation (CA)

( * ) Notice: Subject to any disclaimer, the term of this patent is extended or adjusted under 35 U.S.C. 154(b) by 0 days.

(21) Appl. No.: 09/879,407

(22) Filed: Jun. 11, 2001

(65) Prior Publication Data

US 2002/0184979 A1 Dec. 12, 2002

(51) Int. Cl.[7] ..... B25G 1/08
(52) U.S. Cl. ..... 81/490; 81/177.4
(58) Field of Search ..... 81/177.4, 490

(56) References Cited

U.S. PATENT DOCUMENTS

| | | | | | |
|---|---|---|---|---|---|
| 4,932,294 | A | * | 6/1990 | Chang | 81/490 |
| 5,265,504 | A | | 11/1993 | Fruhm | |
| 5,749,271 | A | * | 5/1998 | Liu | 81/490 |
| 5,810,525 | A | * | 9/1998 | Ector, Sr. | 81/490 |
| 6,305,815 | B1 | * | 10/2001 | Lin | 81/490 |

FOREIGN PATENT DOCUMENTS

WO WO 00/09295 2/2000

OTHER PUBLICATIONS

Model 2211–01 SKIL Super Twist Screwdriver, undated brochure of S–B Power Tool Company, Chicago, Illinois, at http://www.skil.com/cd–html/s3k00020.htm.

Model 2207 SKIL Twist Xtra Screwdriver, undated brochure of S–B Power Tool Company, Chicago, Illinois, at http://www.skil.com/cd–html/s3k00019.htm.

Model 2105 SKIL Twist Screwdriver, undated brochure of S–B Power Tool Company, Chicago, Illinois, at http://www.skil.com/cd–html/s3k00038.htm.

Model VP750 3.6 volt Cordless VersaPak 2 Position Pivot Driver Screwdriver, 2000 brochure of The Black & Decker Corporation, at http://www.blackanddecker.com/product-guide/productdetail.asp?PRODUCT_ID=2325.

Model 6705DW Cordless Screwdriver, undated brochure of Makita U.S.A., Inc., La Mirada, Calif., at http://www.makita.com/product/tool.asp?MODEL=6705DW.

Heavy–Duty 7.2V Cordless Screwdriver—DW920K–2, undated brochure of The DeWalt Industrial Tool Company, Baltimore, MD, at http://www.dewalt.com/us/products/tool_detail.asp?procudtID=2739.

2.4V Screw Driver EY503B, undated brochure of Matsushita Electric Corporation of America, Secaucus, NJ, at http://www.panasonic.com/commercial_building/power_tools/Scripts/Model/PHCC_PowerTools_template.asp-?ModelId=8521&CategoryId=1457&Index=1.

* cited by examiner

*Primary Examiner*—James G. Smith
(74) *Attorney, Agent, or Firm*—Oyen Wiggs Green & Mutala

(57) ABSTRACT

A bit holder for a battery-powered screwdriver. A compartment is formed on one end of the screwdriver, opposite the tool bit driving end of the screwdriver. A sleeve mounted in the compartment can be slidably moved between open and closed positions. A plurality of bit holding clips are fixed around the sleeve's outer circumference. A shaft extends through the compartment. One of the shaft's ends is fixed at the compartment's forward end. The sleeve is slidably mounted over the shaft's opposite end.

7 Claims, 2 Drawing Sheets

BATTERY-POWERED SCREWDRIVER WITH INTEGRAL BIT HOLDER

TECHNICAL FIELD

This invention provides a battery-powered screwdriver with an integral bit holder in which a plurality of different bits may be stored.

BACKGROUND

Battery-powered screwdrivers are becoming increasingly popular. A variety of different bits can be used with such screwdrivers. Commonly, the bits are stored apart from the screwdriver. That can be inconvenient; in many cases, it would be more convenient if the bits were stored on or in the screwdriver itself. This would give the user ready access to a supply of different bits, thus avoiding the need to locate and manipulate a separate bit storage container.

Various prior art manually operated screwdrivers have integral bit storage capability. For example, U.S. Pat. No. 5,265,504 issued Nov. 30, 1993 discloses a "Cartridge Type Screwdriver" having a bit storage magazine within the screwdriver's handle. A plurality of different bits are held in place by clips provided around the circumference of the storage magazine. By pulling a cap longitudinally away from the handle, one may slidably withdraw the magazine from the handle to expose the bits. A particular bit can be selected and removed from its clip. The user then presses against the cap to slide the storage magazine back inside the handle.

Unlike a manually-operated screwdriver, which can be provided with a hollow handle suitable for receiving a bit storage magazine, a battery-operated screwdriver has no readily apparent space for receiving a bit storage magazine. The present invention solves that problem to facilitate integration of a bit holder and battery-operated screwdriver in a relatively compact configuration and without impairing the functionality of either the screwdriver or the bit holder.

SUMMARY OF INVENTION

The invention provides a bit holder for a battery-powered screwdriver. A compartment is formed on one end of the screwdriver, opposite the tool bit driving end of the screwdriver. A sleeve mounted in the compartment can be slidably moved between open and closed positions. A plurality of bit holding clips are fixed around the sleeve's outer circumference. A shaft extends through the compartment. One of the shaft's ends is fixed at the compartment's forward end. The sleeve is slidably mounted over the shaft's opposite end.

An end cap is fixed on the sleeve's rearward end. An internal, radially outwardly enlarged circumferential recess is provided on the cap's forward face. A radially flexible retainer is fixed on the shaft's rearward end. The retainer flexes radially outwardly into the recess when the bit holder is in the closed position, thereby retaining the bit holder in the closed position. When the bit holder is in the closed position, application of a force to move the end cap rearwardly away from the compartment flexes the retainer radially inwardly and away from the recess.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
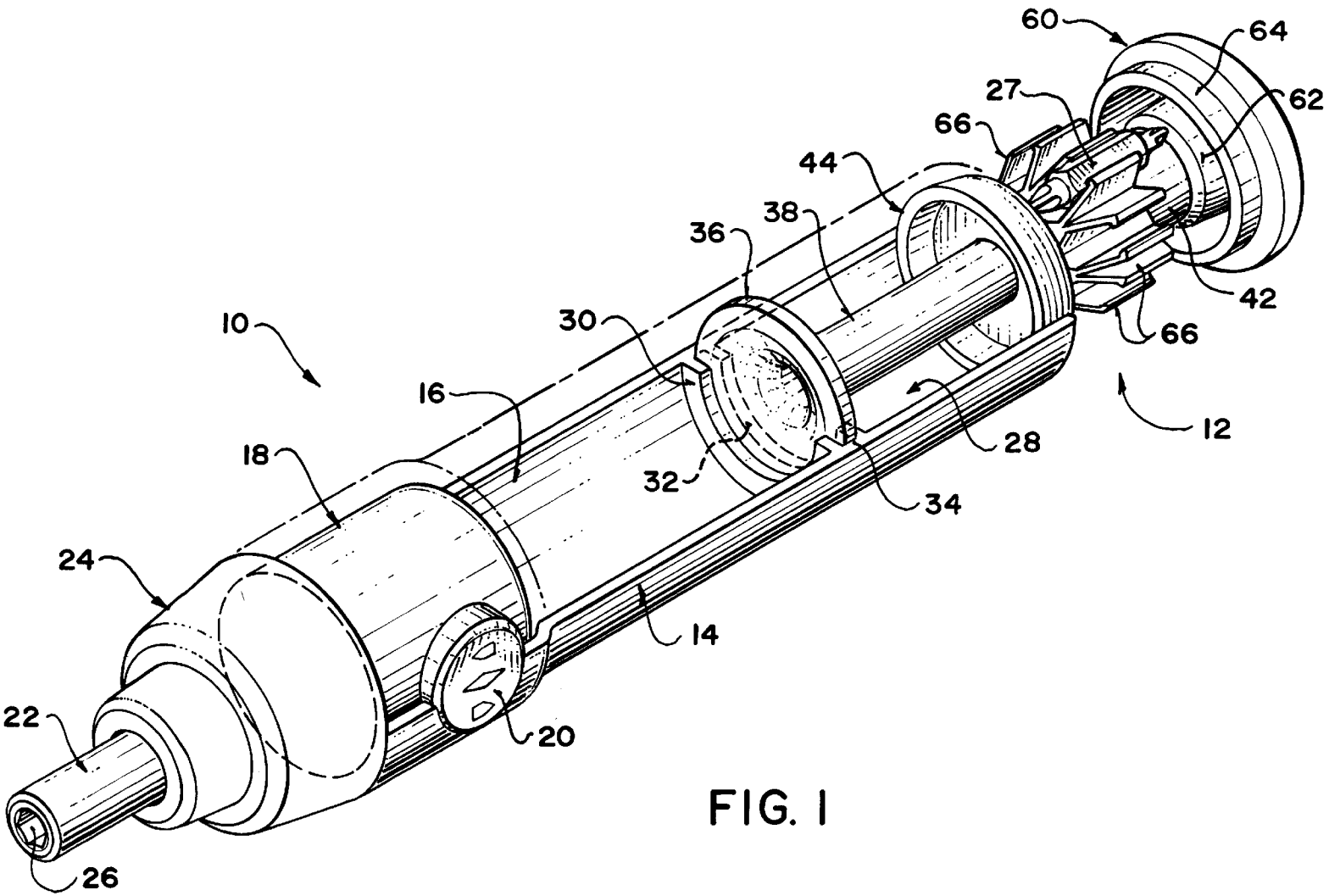
FIG. 1 is a partially fragmented, partially schematic oblique pictorial illustration of a battery-powered screwdriver having an integral bit holder in accordance with the invention, showing the bit holder in the open position.
Figure 2:
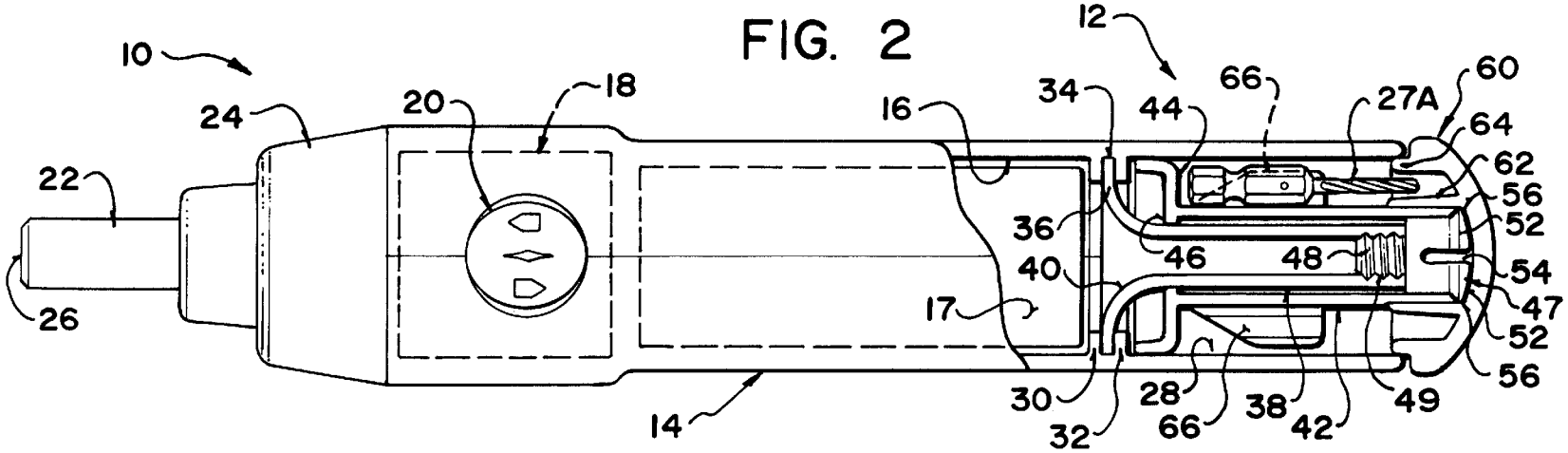
FIG. 2 is a partially fragmented, partially sectioned side elevation view of the FIG. 1 apparatus, showing the bit holder in the closed position.
Figure 3:
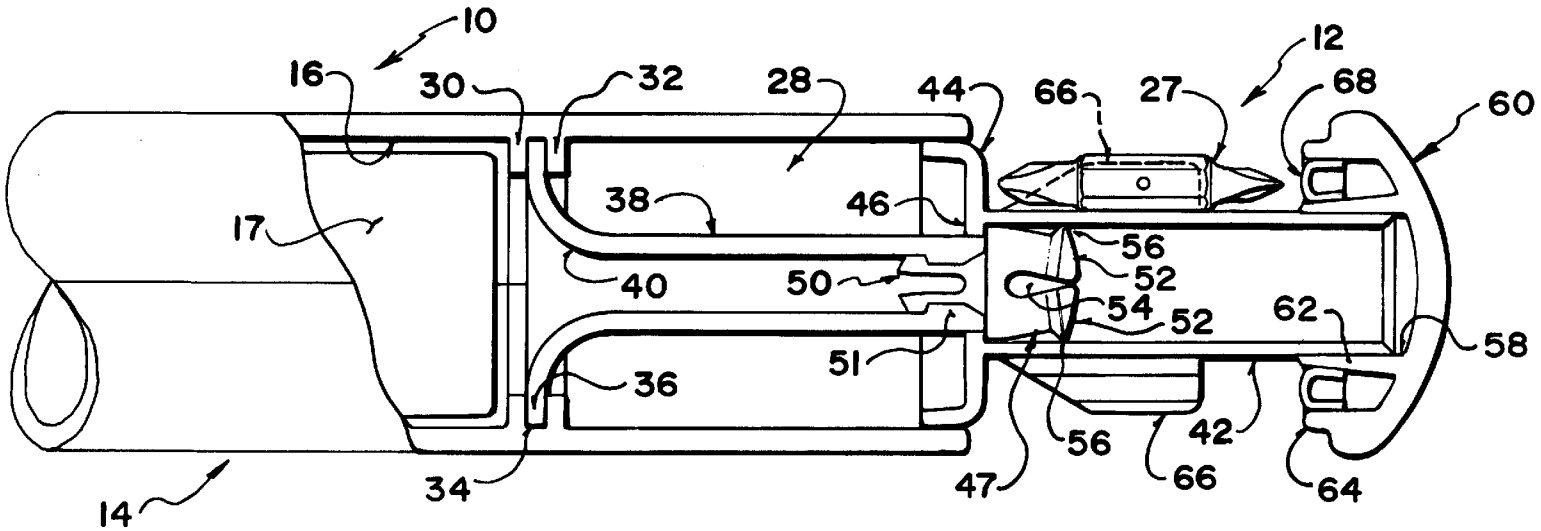
FIG. 3 is an enlarged, partially fragmented, partially sectioned side elevation view of the bit holder end portion of the FIGS. 1 and 2 apparatus, showing the bit holder in the open position.

FIGS. 1, 2 and 3 depict a battery-powered screwdriver 10 having an integral bit holder 12 in accordance with the invention. Screwdriver 10 has a casing 14 within which a compartment 16 is formed for containing battery 17 (shown schematically only in FIGS. 2 and 3). Battery 17 powers motor 18 (shown schematically only in FIGS. 1 and 2) when rocker switch 20 is actuated, rotating shaft 22 about its longitudinal axis. Shaft 22 is drivingly coupled to motor 18 by a gearing mechanism (not shown) within forward compartment 24. A hexagonal cross-section tool bit holding chuck 26 is provided in the open forward end of shaft 22 for removably and lockably receiving any one of a number of different (preferably double-ended) screwdriver type tool bits 27 (FIGS. 1 and 3), or an assortment of drill type tool bits 27A (FIG. 2) stored within bit holder 12. The external surface of casing 14 defines a handle for grasping screwdriver 10.

The end of casing 14 opposite shaft 22 is extended rearwardly (i.e. to the right, as viewed in FIGS. 2 and 3) to define a bit holder storage compartment 28 rearwardly of battery storage compartment 16. A pair of opposed flanges 30, 32 are formed to extend circumferentially around the inner cylindrical surface of casing 14, rearwardly of battery storage compartment 16. Flanges 30, 32 are spaced apart to define a circumferential groove 34 for fixedly retaining the circular rim of base 36 of support shaft 38. As best seen in FIGS. 2 and 3, base 36 is flared radially inwardly and rearwardly to define an anchor flange portion 40 at the juncture of base 36 and shaft 38.

A cylindrically apertured sleeve 42 is formed on the central rearward face of support collar 44 and extends rearwardly therefrom. Stop shoulder 46 on support collar 44 circumferentially surrounds shaft 38 for slidable, longitudinal movement of sleeve 42 and collar 44 forwardly or rearwardly along shaft 38 between the closed and open positions respectively shown in FIGS. 2 and 3. The circumferential outward rim of collar 44 is flanged to bear against the inner cylindrical surface of compartment 28 thereby stabilizing bit holder 12 and preventing "wobbling" of sleeve 42 during slidable movement thereof along shaft 38.

An inwardly flexible retainer 47 is fixed on the rearward end 49 of shaft 38. This can be accomplished, as shown in FIG. 2, by providing external threading 48 on rearward end 49 of shaft 38 and screwing an internally threaded portion (not shown) of retainer 47 onto the threaded shaft end. Alternatively, as shown in FIG. 3, a spring-biased type clip 50 can be provided on the forward end of retainer 47 for snap-fit engagement within a mating flanged portion 51 formed within the rearward end of shaft 38.

Retainer 47 is formed with a plurality of flexible, radially spaced segments 52 separated by slots 54. When bit holder 12 is in the closed position shown in FIG. 2, segments 52 flex radially outwardly, forcing the outwardly protruding circumferential ridged portions 56 of segments 52 into snap-fit engagement within radially outwardly enlarged circumferential recess 58 provided within the central, forward face of end cap 60 to firmly retain bit holder 12 in the closed position. The forward end of retainer 47 protrudes radially outwardly around the rearward end of shaft 38, thereby serving as an end stop to limit rearward travel of sleeve 42 on shaft 38 when stop shoulder 46 contacts the forward end of retainer 47.

A cylindrically apertured collar 62 is formed around the central, forward face of cap 60. The circumferential inward surface of collar 62 is securely circumferentially bonded to the rearward end of sleeve 42. To move bit holder 12 into the open position shown in FIG. 3, the user grasps end cap 60 and draws it longitudinally away from screwdriver 10 (i.e. by pulling end cap 60 to the right, as viewed in FIG. 2). The force so exerted compresses segments 52 of retainer 47 radially inwardly within recess 58, such that ridges 56 circumscribe a reduced circumference capable of passage through the cylindrically apertured portion of sleeve 42, as sleeve 42 is slidably drawn along shaft 38 into the fully open position shown in FIG. 3.

A second collar 64 is formed around the central, forward face of cap 60 circumferentially surrounding collar 62. The forwardly protruding portion of collar 64 is received within the rearward circumferential end of casing 14 when bit holder 12 is in the closed position, as shown in FIG. 2.

A plurality of flexible bit holding clips 66 are spaced radially and fixed around the central outer circumference of sleeve 42. One bit can be press fitted and thus removably retained between each opposed pair of clips 66 to removably retain the bit. A plurality of different bits can be similarly removably retained by utilizing all of the available pairs of clips 66 on bit holder 12. When bit holder 12 is in the open position shown in FIG. 3, it can easily be rotated with respect to shaft 38, thereby allowing the user to easily inspect all of the bits stored on bit holder 12 and select a particular bit. The selected bit can be removed by pulling it outwardly away from the clips 66 which retain it. End cap 60 is then pressed toward screwdriver 10 to slidably replace bit holder 12 within bit storage compartment 28 in the closed position shown in FIG. 2.

As will be apparent to those skilled in the art in the light of the foregoing disclosure, many alterations and modifications are possible in the practice of this invention without departing from the spirit or scope thereof. As one example, instead of slidably interconnecting shaft 38 and sleeve 42 as aforesaid, one could dispense with shaft 38 and substitute a "plunger" on the forward end of sleeve 42 for slidable reciprocation of the plunger within and against the internal cylindrical wall enclosing bit holder storage compartment 28 between end stops formed around opposed ends of compartment 28. As another example, an annular bit stop ring 68 can be provided between collars 62, 64 to prevent (in cooperation with support collar 44) excessive longitudinal movement of bits 27, 27A within bit holder storage compartment 28 and thereby inhibit possible dislodgement of bits 27, 27A from clips 66 if screwdriver 10 is inadvertently dropped or subjected to other impact forces. If extended drill bits 27A (FIG. 2) are utilized, apertures (not shown) can be bored at appropriate locations in bit stop ring 68 to allow the ends of the drill bits to protrude rearwardly through bit stop ring 68. The scope of the invention is to be construed in accordance with the substance defined by the following claims.

What is claimed is:

1. A bit holder for a battery-powered screwdriver having a battery compartment containing a battery, a motor compartment containing a motor electrically coupled to said battery, and a drive compartment containing a drive mechanism mechanically coupling said motor to a tool bit driving end of said screwdriver, said bit holder comprising:

(a) a bit storage compartment formed on one end of said screwdriver opposite said tool bit driving end of said screwdriver and rearwardly of said battery compartment, said motor compartment and said drive compartment, said bit storage compartment containing a bit storage space not contained by any of said battery compartment, said motor compartment and said drive compartment;

(b) a shaft extending axially through said bit storage compartment without extending forwardly of said bit storage compartment into any of said battery compartment, said motor compartment and said drive compartment, one end of said shaft fixed at a forward end of said bit storage compartment;

(c) a sleeve slidably mounted within said bit storage compartment for movement of said sleeve between open and closed positions, said sleeve slidably receivable over an opposed second end of said shaft for slidable movement of said sleeve along said shaft between said open and closed positions; and, (d) a plurality of bit holding clips fixed around an outer circumferential portion of said sleeve.

2. A bit holder as defined in claim 1, further comprising:

(a) an end cap fixed on a rearward end of said sleeve, a forward face of said end cap having an internal, radially outwardly enlarged circumferential recess;

(b) a radially flexible retainer fixed on a rearward end of said shaft;

wherein;

(i) said retainer flexes radially outwardly into said recess when said sleeve is in said closed position, thereby retaining said bit holder in said closed position; and, (ii) when said sleeve is in said closed position, application of a force to move said end cap rearwardly away from said bit storage compartment flexes said retainer radially inwardly and away from said recess.

3. A bit holder as defined in claim 1, further comprising:

(a) a circumferential groove formed around said forward end of said bit storage compartment; and (b) a circular base fixed to a forward end of said shaft, said base having a rim mounted within said groove.

4. A bit holder as defined in claim 1, further comprising a collar fixed to and extending radially outwardly from a forward end of said sleeve, said collar having a circumferential outward rim for bearing against an inner surface of said bit storage compartment during said movement of said sleeve betweeen said open and closed positions.

5. A bit holder as defined in claim 4, further comprising a flange on said collar rim, said flange providing an extended bearing region between said collar and said sleeve for stabilizing said sleeve during said movement of said sleeve between said open and closed positions.

6. A bit holder as defined in claim 4, further comprising a retainer fixed on and protruding radially outwardly around a rearward end of said shaft, said collar having a stop shoulder extending radially inwardly around said forward end of said sleeve, said stop shoulder butting against said retainer to limit rearward travel of said sleeve during said movement of said sleeve between said open and closed positions.

7. A bit holder as defined in claim 4, further comprising an end cap fixed on a rearward end of said sleeve, a forward face of said end cap having an annular stop ring for confining longitudinal movement of said bits between said collar and said stop ring when said sleeve is in said closed position.

* * * * *